US008282421B2

(12) United States Patent
Lee et al.

(10) Patent No.: US 8,282,421 B2
(45) Date of Patent: Oct. 9, 2012

(54) BACKPLANE CONNECTOR WITH GUIDING ELEMENTS

(75) Inventors: Kuo-Ching Lee, Hsin-Tien (TW); Ta-Teh Meng, Hsin-Tien (TW)

(73) Assignee: Advanced Connectek Inc., Hsin-Tien (TW)

( * ) Notice: Subject to any disclaimer, the term of this patent is extended or adjusted under 35 U.S.C. 154(b) by 0 days.

(21) Appl. No.: 13/107,012

(22) Filed: May 13, 2011

(65) Prior Publication Data

US 2012/0083163 A1 Apr. 5, 2012

(30) Foreign Application Priority Data

Oct. 5, 2010 (TW) ..... 99133819 A

(51) Int. Cl.
*H01R 24/00* (2011.01)

(52) U.S. Cl. ..... 439/629

(58) Field of Classification Search ..... 439/629, 439/637, 636, 405, 60, 108
See application file for complete search history.

(56) References Cited

U.S. PATENT DOCUMENTS 7,229,319 B2 6/2007 Dahms et al.
7,824,224 B2 * 11/2010 Su et al. ..... 439/629
2007/0141872 A1 * 6/2007 Szczesny et al. ..... 439/108
2010/0136839 A1 * 6/2010 Su et al. ..... 439/629
2010/0317234 A1 * 12/2010 Yao et al. ..... 439/637
2011/0136388 A1 * 6/2011 Fu et al. ..... 439/637
2012/0083163 A1 * 4/2012 Lee et al. ..... 439/629

* cited by examiner

*Primary Examiner* — Tulsidas C Patel
*Assistant Examiner* — Phuongchi Nguyen
(74) *Attorney, Agent, or Firm* — Rabin & Berdo, P.C.

(57) ABSTRACT

A backplane connector has a housing and multiple terminal assemblies. The housing has a top, a bottom and an expansion slot defined in the top. The terminal assemblies are mounted in the bottom of the housing and each terminal assembly has a first insulating base, a second insulating base and two pairs of signal transmission terminals. The first and second insulating bases are connected to each other. The pairs of the signal transmission terminals are mounted respectively through the first and second insulating bases. Each signal transmission terminal has a curved guide element and an angled protruding element. The curved guiding elements smoothly contacts and guides an electrical connecting portion of a PCB expansion card to move so that the PCB expansion card is installed easily in the expansion slot of the backplane connector.

5 Claims, 11 Drawing Sheets

BACKPLANE CONNECTOR WITH GUIDING ELEMENTS

BACKGROUND OF THE INVENTION

1. Field of the Invention

The present invention relates to a connector, and more particularly to a backplane connector that has guiding elements and facilitates insertion of a printed circuit board (PCB) expansion card therein and prevents the PCB expansion card from inadvertent disengagement from the backplane connector.

2. Description of Related Art

Servers such as blade servers and rack mount servers have a PCB mounted with backplane connectors for high speed and stable signal transmission thus to avoid using cable connectors that have deformation, disorder and durable problems.

U.S. Pat. No. 7,229,319 discloses a backplane connector on a PCB and having a housing and multiple disk shaped contact modules. The housing has an insertion slot and multiple spaces. The insertion slot may receive an accessory card. The contact modules are mounted respectively in the spaces and are arranged abreast in a row. Each contact module has an insulating member and a pair of electrical contacts. The electrical contacts may be a differential signaling pair, is mounted on the insulating member by inserting molding processes and provides electrical connection.

However, the aforementioned backplane connector has following disadvantages.

1. When a PCB expansion card is inserted in and connected to the backplane connector, the electrical contacts of the contact modules cannot smoothly guide an insertion portion of the PCB expansion card into the backplane connector. Furthermore, the PCB expansion card mounted completely in the backplane connector easily slips and separates from the backplane connector to causes signal transmission failure.

2. Each contact module has its individual tolerance. When all the contact modules are arranged abreast together, a total tolerance thereof always exceeds the reasonable expectation, which causes fabrication failure of the backplane connector and the deformation, loosening and disassembly of the contact modules. Therefore, the durability and production rate of the backplane connector are decreased.

3. The housing is hollow and implemented without any crossbeam structures so is structurally weak and cannot protect the contact modules therein, which further makes the signal transmission of the backplane connector unstable.

To overcome the shortcomings, the present invention provides a backplane connector with guiding elements to mitigate or obviate the aforementioned problems.

SUMMARY OF THE INVENTION

The main objective of the invention is to provide a backplane connector that has guiding elements and facilitates insertion of a printed circuit board (PCB) expansion card therein and prevents the PCB expansion card from inadvertent disengagement from the backplane connector.

A backplane connector in accordance with the present invention comprises a housing and multiple terminal assemblies. The housing has a top, a bottom and an expansion slot defined in the top. The terminal assemblies are mounted in the bottom of the housing and each terminal assembly has a first insulating base, a second insulating base and two pairs of signal transmission terminals. The first and second insulating bases are connected to each other. The pairs of the signal transmission terminals are mounted respectively through the first and second insulating bases. Each signal transmission terminal has a curved guide element and an angled protruding element. The curved guiding elements smoothly contacts and guides an electrical connecting portion of a PCB expansion card to move so that the PCB expansion card is installed easily in the expansion slot of the backplane connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
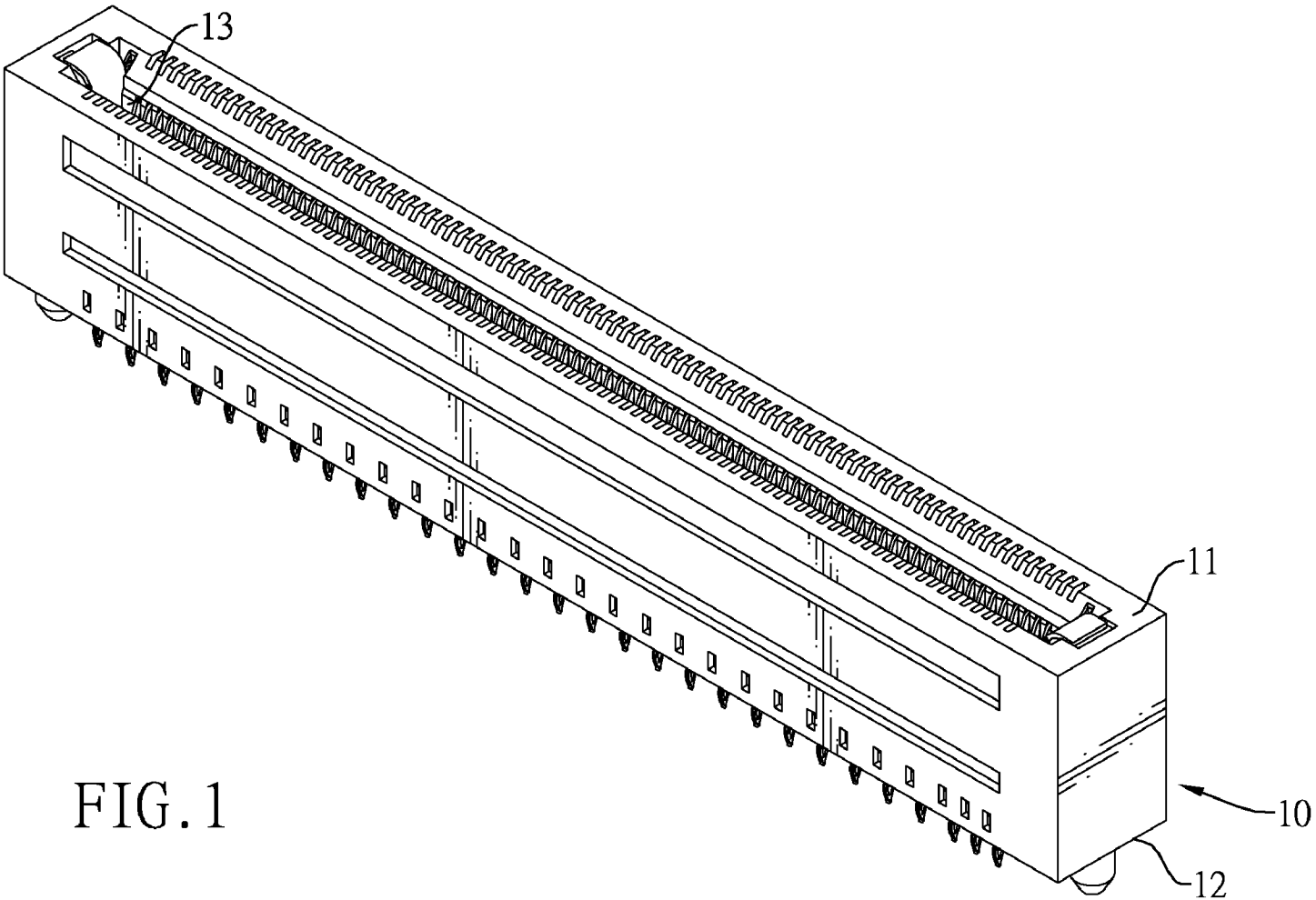
FIG. 1 is a perspective view of a backplane connector with guiding elements in accordance with the present invention.
Figure 2:
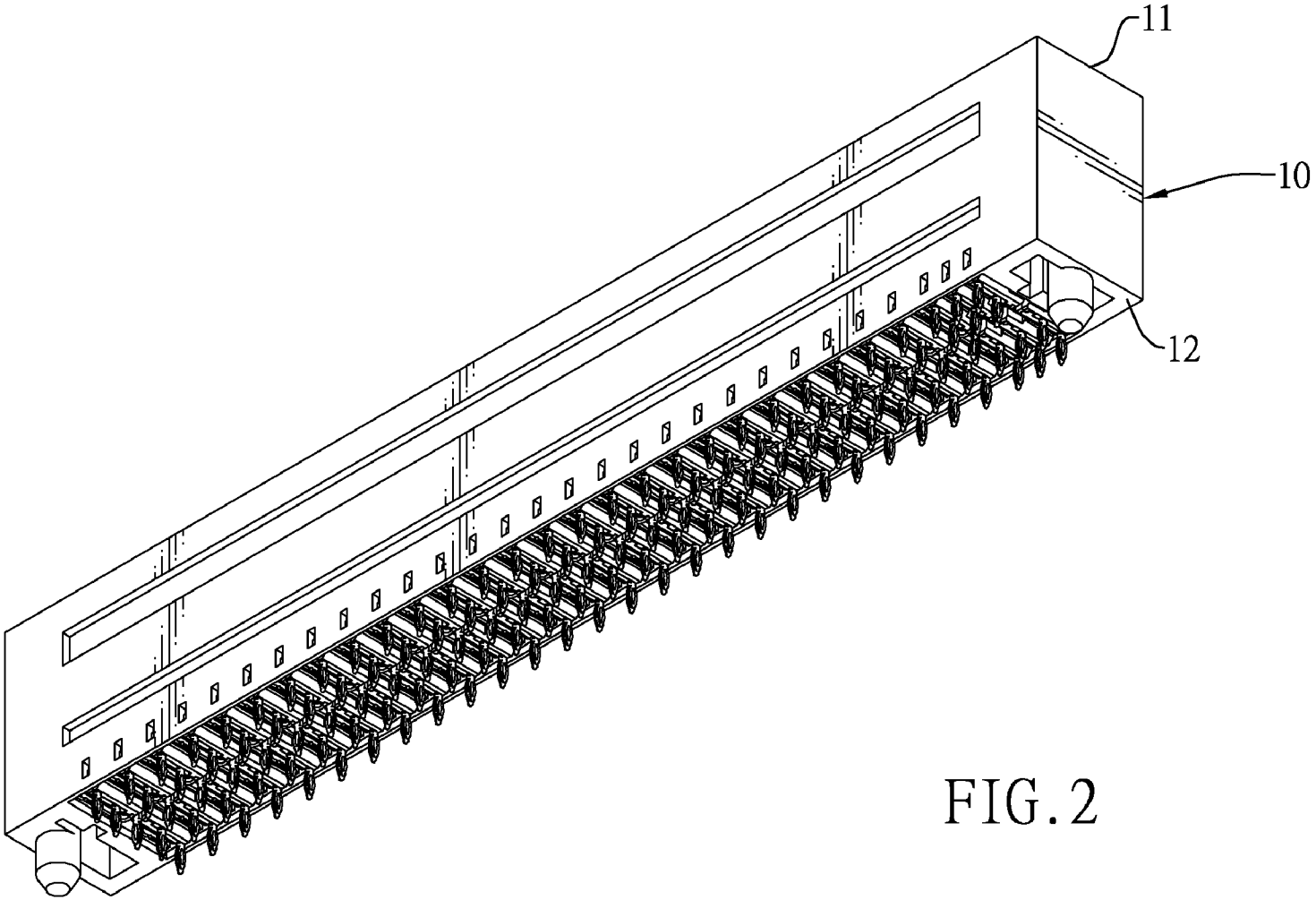
FIG. 2 is another perspective view of the backplane connector in FIG. 1.
Figure 3:
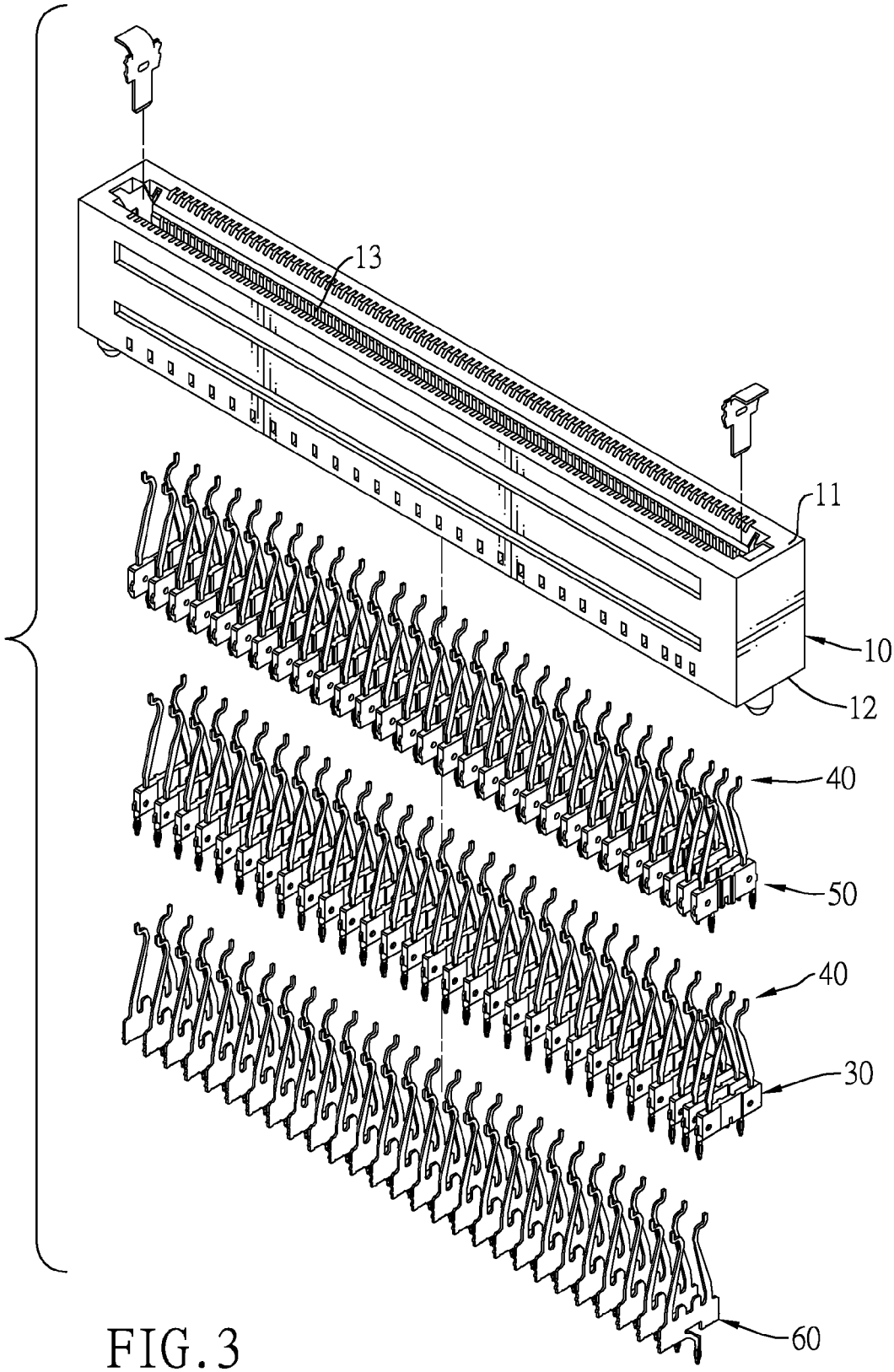
FIG. 3 is an exploded perspective view of the backplane connector in FIG. 1.
Figure 4:
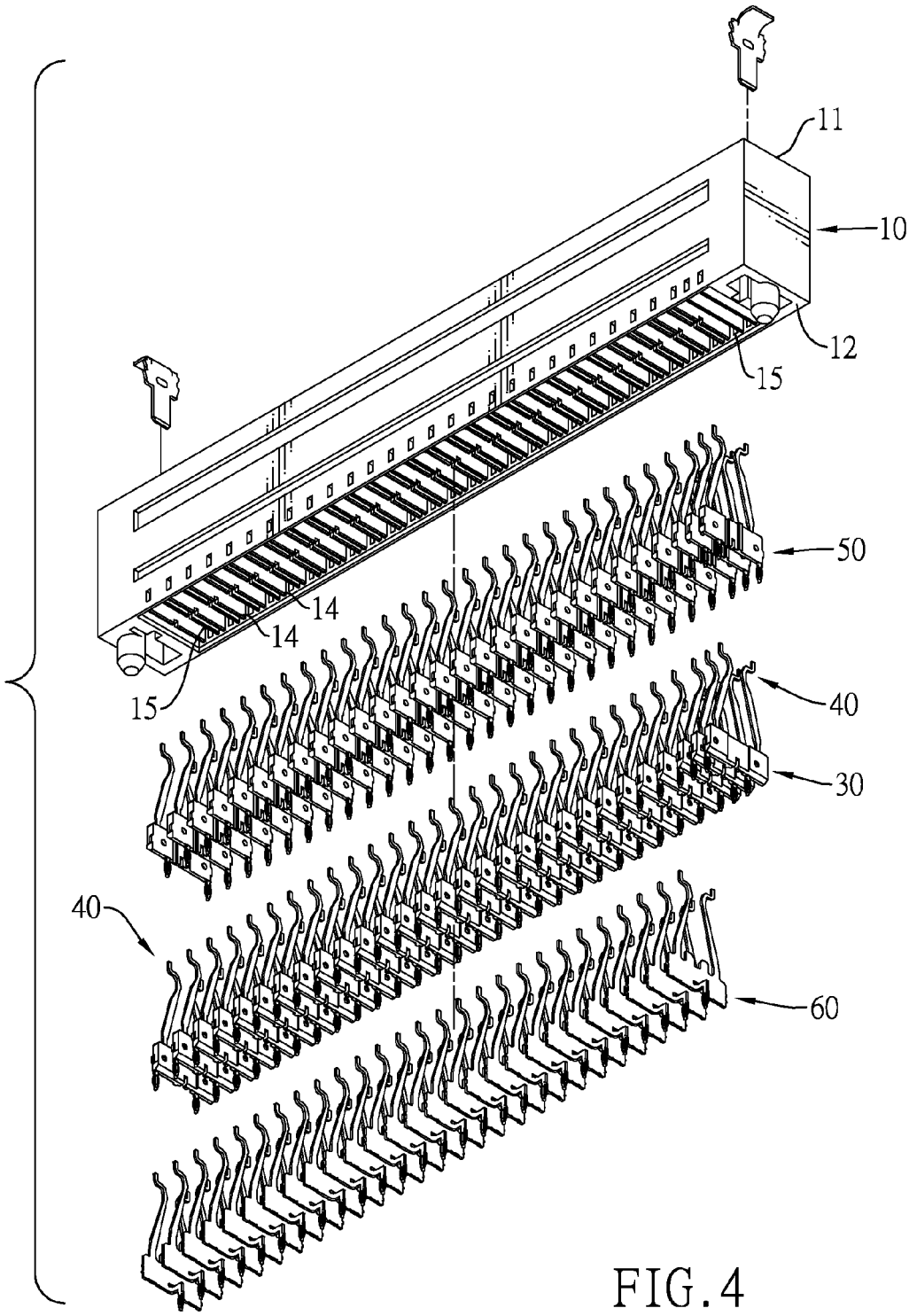
FIG. 4 is another perspective view of the backplane connector in FIG. 2.
Figure 5:
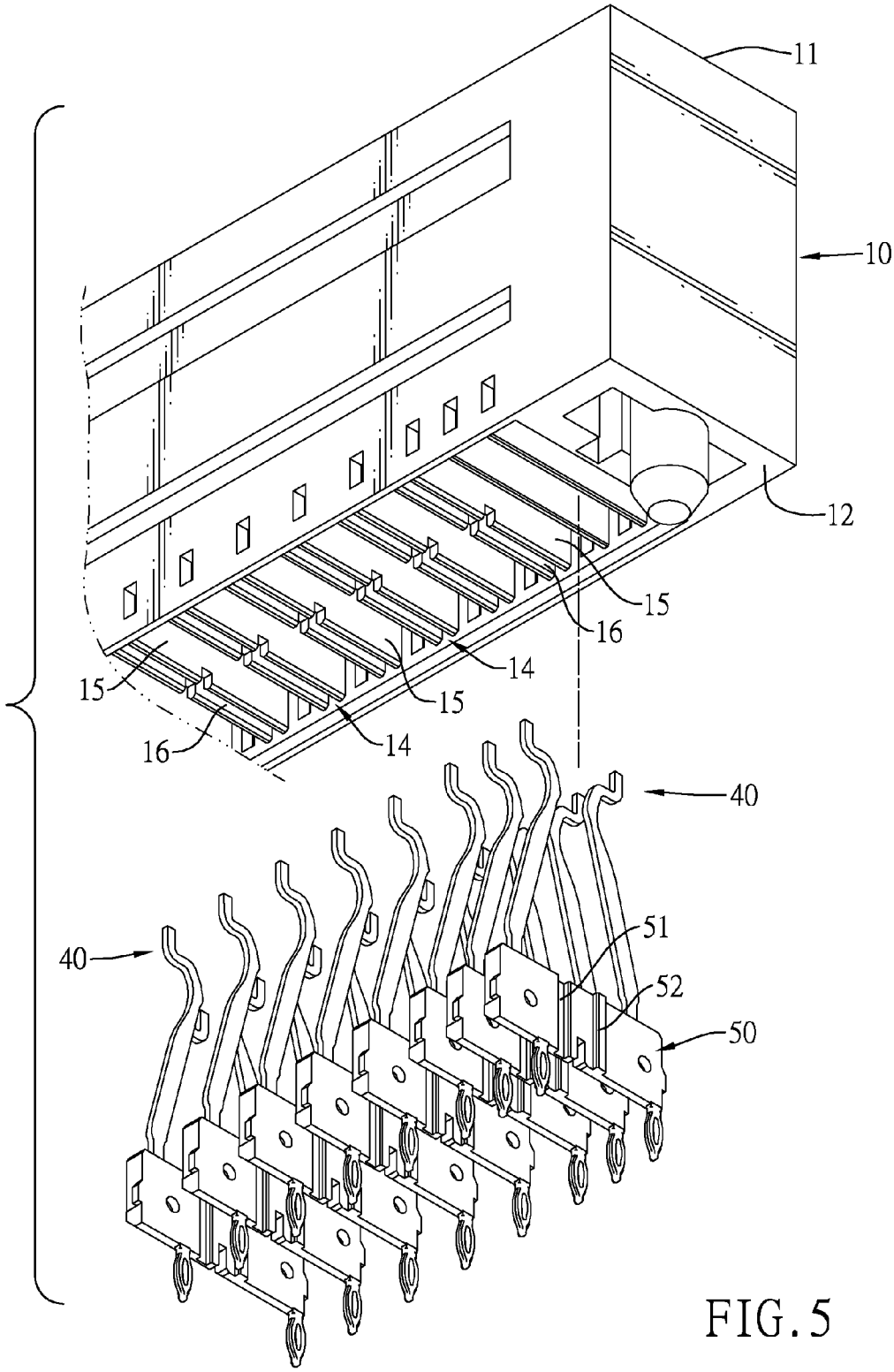
FIG. 5 is an enlarged exploded perspective view of the backplane connector in FIG. 4.
Figure 6:
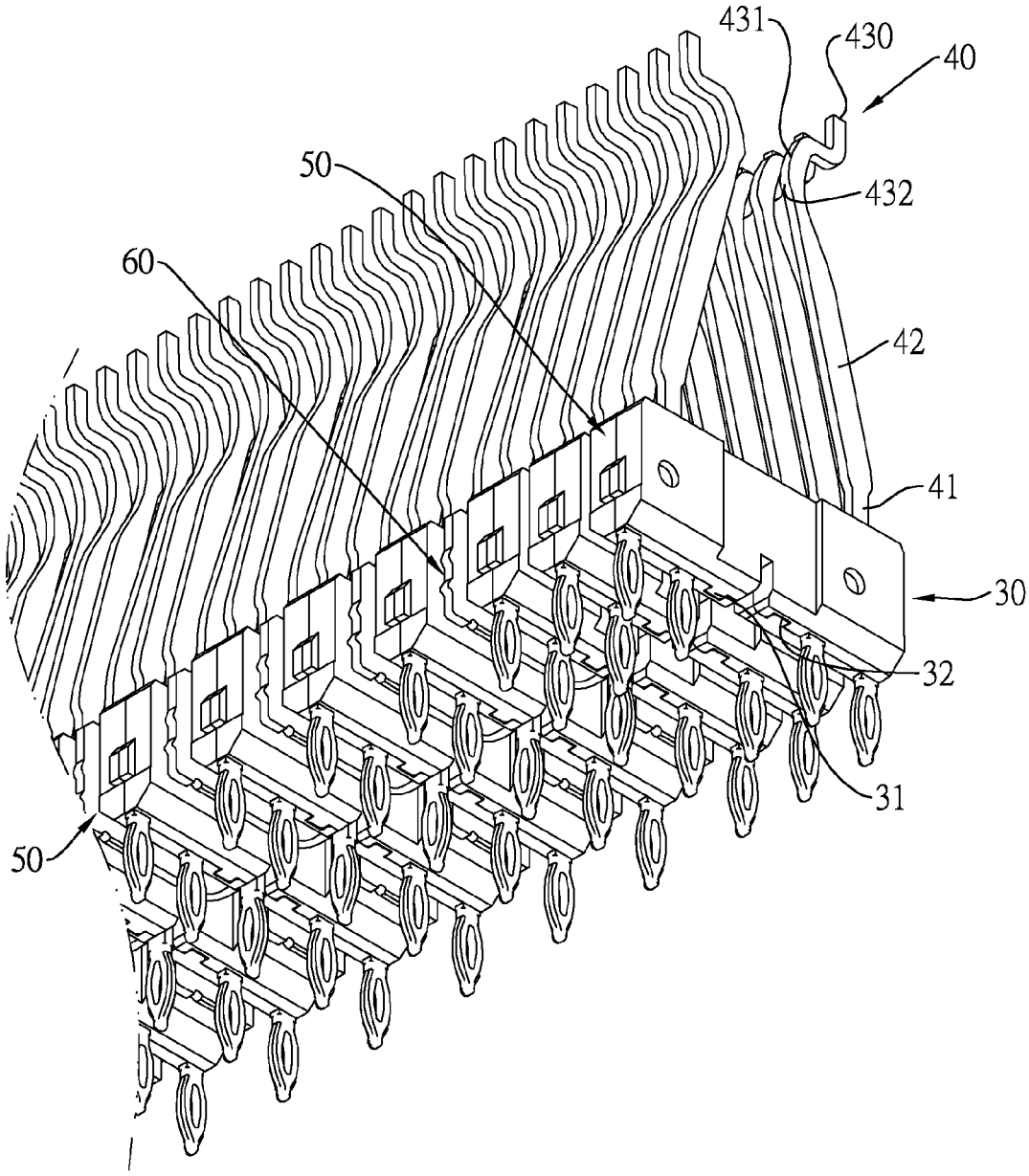
FIG. 6 is an enlarged perspective view of the backplane connector omitting the housing in FIG. 2.
Figure 7:
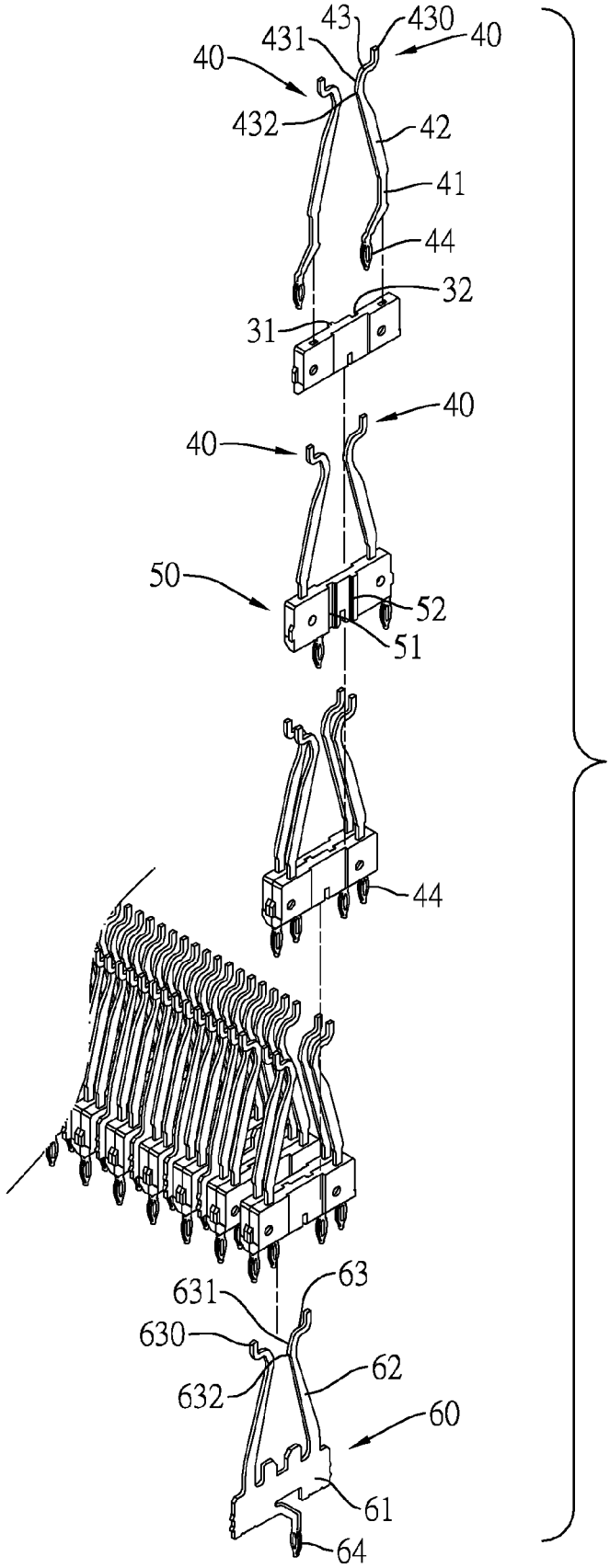
FIG. 7 is an enlarged exploded perspective view of terminal assemblies of the backplane connector in FIG. 6.

With reference to FIGS. 1 to 5, a backplane connector in accordance with the present invention comprises a housing (10), multiple terminal assemblies and multiple grounding terminals (60).

The housing (10) is longitudinal, may be formed by an insert-molding process, has a top (11), a bottom (12) and an expansion slot (13) and may further have multiple partitions (14), multiple assembling slots (15), a spine (17), multiple mounting slots (16) and two pressing bars (18).

The expansion slot (13) is defined in the top (11) of the housing (10).

The partitions (14) are formed transversely on the bottom (12) of the housing (10) and are arranged longitudinally.

The assembling slots (15) are defined in the bottom of the housing (10) and are arranged alternately with the partitions (14) so that each assembling slot (15) is disposed between adjacent partitions (14).

The spine (17) is formed longitudinally on the housing (10) between the expansion slot (13) and the assembling slots (15).

Figure 8:
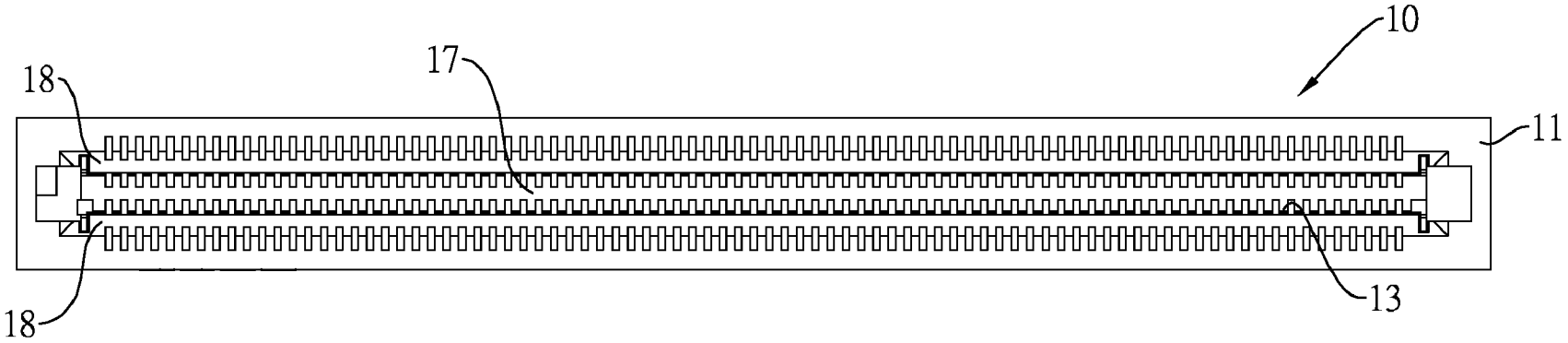
FIG. 8 is a top view of the backplane connector in FIG. 1.
Figure 9:
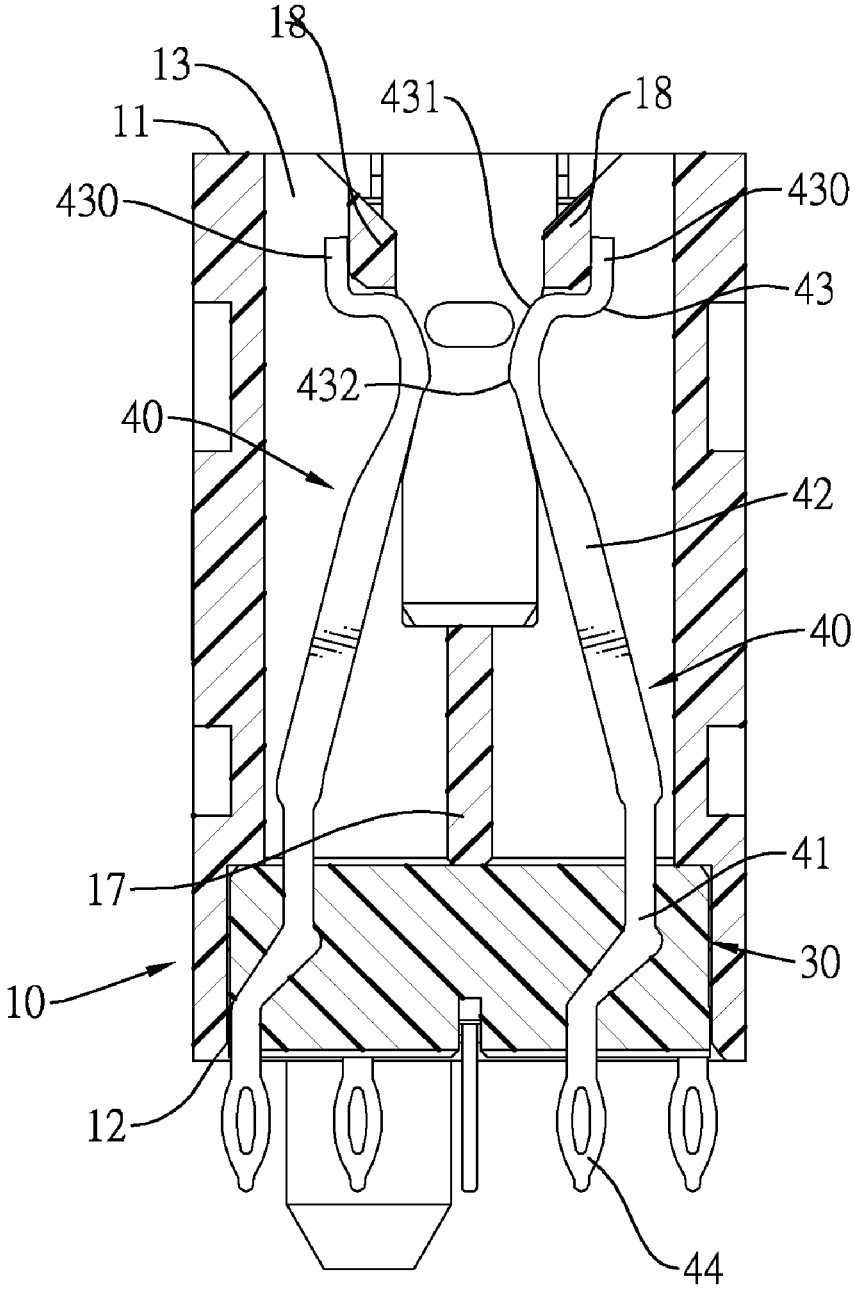
FIG. 9 is a cross sectional end view of the backplane connector in FIG. 1.

With further reference to FIGS. 8 and 9, the mounting slots (16) are defined respectively in the partitions (14) adjacent the bottom (12) and communicate with the expansion slot (13).

The pressing bars (18) are formed longitudinally in the expansion slot (13) and are arranged symmetrically to each other.

With further reference to FIGS. 5 to 9, the terminal assemblies are mounted in the bottom (12) of the housing (10), may be mounted respectively through and correspond to the assembling slots (15) of the housing (10) and each terminal assembly has a first insulating base (30), a second insulating base (50) and two pairs of signal transmission terminals (40).

The first insulating base (30) and the second insulating base (50) are connected to each other, are mounted in the bottom (12) of the housing (10) and may be mounted in a corresponding assembling slot (15) of the housing (10). Furthermore, the first insulating base (30) may have at least two protruding/recessed first engaging members (31, 32) formed on the first insulating base (30). The second insulating base (50) may have at least two recessed/protruding second engaging members (51, 52) formed on the first insulating base (50) and engaged respectively with the at least two protruding/recessed first engaging members (31, 32).

The pairs of the signal transmission terminals (40) are mounted respectively through the first insulating base (30) and the second insulating base (50) by insert-molding processes. The signal transmission terminals (40) of each pair are arranged symmetrically. Furthermore, each signal transmission terminal (40) has a first mounting section (41), a first resilient arm (42), a first contacting section (43) and a first soldering section (44).

The first mounting section (41) is mounted on one of the first insulating base (30) or the second insulating base (40).

The first resilient arm (42) is formed on and protrudes upward from the first mounting section (41).

The first contacting section (43) is formed on and protrudes upward from the first resilient arm (42) and has an inner side, a curved guiding element (431) and an angled protruding element (432) and may further have a first abutting section (430). The inner sides of the first contacting sections (43) of the signal transmission terminals (40) of each pair are opposite and face each other. The curved guiding element (431) is formed on the inner side and may be convex. The angled protruding element (432) is formed on the inner side and is disposed under and adjacent to the curved guiding element (431).

The first soldering section (44) is formed on and protrudes downward from first mounting section (41) and extends out of the bottom (12) of the housing (10). Furthermore, the first soldering sections (44) of the signal transmission terminals (40) of each terminal assembly may be arranged in a single transverse row relative to the housing (10).

Figure 10:
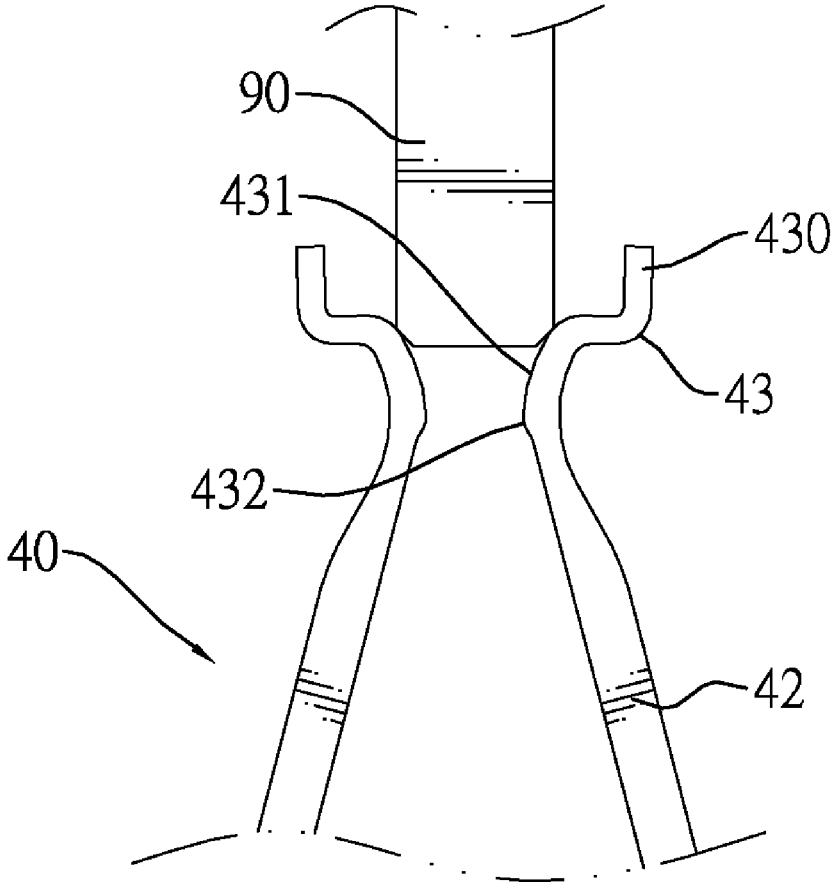
FIG. 10 is an operational cross sectional view of a PCB expansion card inserted halfway into a space between the terminals of each pair of the backplane connector in FIG. 1.
Figure 11:
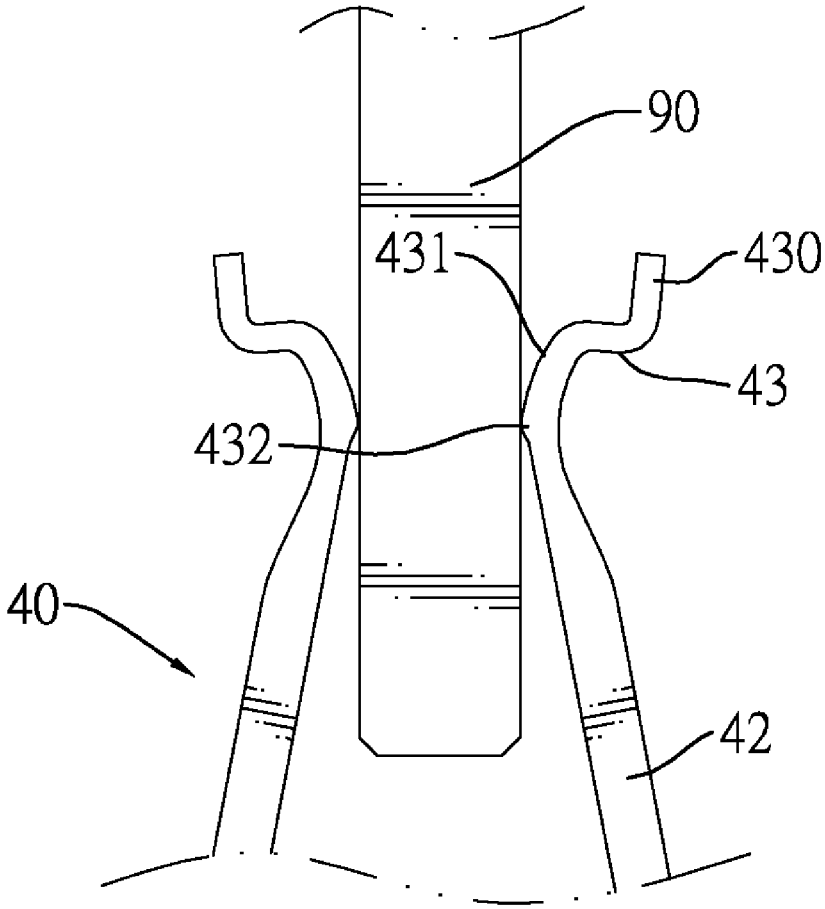
FIG. 11 is an operational cross sectional view of a PCB expansion card inserted completely into the space between the terminals of each pair of the backplane connector in FIG. 1.

With further reference to FIGS. 10 to 11, when a PCB expansion card such as a graphics card or a redundant array of independent Disks (RAID) card is inserted and mounted in the expansion slot (13) of the backplane connector, an electrical connecting portion (90) of the PCB expansion card firstly contacts the curved guiding elements (431) of the first contacting section (43) of the signal transmission terminals (40) of each pair of each terminal assembly. The curved guiding elements (431) smoothly contacts and guides the electrical connecting portion (90) to move so that the electrical connecting portion (90) may be easily slipped downward in the expansion slot (13) of the backplane connector. When the electrical connecting portion (90) is completed inserted into the expansion slot (13), the angled protruding elements of the signal transmission terminals (40) of each pair press tightly against two opposite side surfaces of the electrical connecting portion (90) to prevent the PCB expansion card from inadvertently loosening and moving, which achieves highly stable signal transmission between the PCB expansion card and the backplane connector.

The first abutting section (430) is L-shaped, is formed on and protrudes upward from the first contacting section (43) and tightly abuts one of the pressing bars (18) of the housing (10).

The grounding terminals (60) are mounted respectively through the mounting slots (16) of the housing (10). Each grounding terminal (60) has a second mounting section (61), two second resilient arms (62), two second contacting sections (63) and a second soldering section (64).

The second mounting section (61) is mounted in one of the mounting slots (16).

The second resilient arms (62) are formed on and protrude upward from the second mounting section (61) and are arranged symmetrically to each other.

The second contacting sections (63) are formed respectively on and protrude upward from the second resilient arm (62) and each second contacting section (63) has an inner side, a curved guiding element (631) and an angled protruding element (632) and may further have a second abutting section (630).

The inner sides of the second contacting sections (63) of the signal grounding terminals (60) of each pair are opposite and face each other. The curved guiding element (631) is formed on the inner side and may be convex. The angled protruding element (632) is formed on the inner side and is disposed under and adjacent to the curved guiding element (631).

The curved guide elements (631) and the angled protruding elements (632) of the grounding terminals (60) function as those of the signal transmission terminals (40).

The second abutting section (630) is L-shaped, is formed on and protrudes upward from the second contacting section (63) and tightly abuts one of the pressing bars (18) of the housing (10).

The second soldering section (64) is formed on and protrudes downward from the second mounting section (61) and extends out of the bottom (12) of the housing (10).

The backplane connector has the following advantages.

1. The curved guiding elements (431, 631) of the signal transmission terminals (40) and the grounding terminals (60) allows the electrical connecting portion (90) of the PCB expansion card to smoothly slide in the expansion slot (13) of the housing (10). When the electrical connecting portion (90) is completely slid in the expansion slot (13), the angled protruding elements (432, 632) press tightly against and plow the side surfaces of the electrical connecting portion (90) and provide friction to position and prevent the PCB expansion card from inadvertently loosening and moving. Therefore, the user needs to pull the PCB expansion card wittingly to when detaching the PCB expansion card form the backplane connector.

2. The pairs of the signal transmission terminals (40) are assembled respectively through the first insulating base (30) and the second insulating base (50) by insert-molding processes first. Then the first insulating base (30) and the second insulating base (50) are assembled to each other to form a terminal assembly. Then the terminal assembly is mounted in one of the assembling slots (15) of the housing (10). The partitions (14) and the assembling slots (15) formed by an insert-molding process have sufficient manufacturing precision to prevent some of the assembling slots (15) from excessively shifting from their predetermined locations. Therefore, the terminal assemblies mounted in the assembling slots (15) can be precisely disposed at predetermined locations relative to the housing (10) to avoid undesirable large total tolerance as presented in conventional backplane connector. Thus, the deformation, loosening and disassembling problems of the backplane connector are avoided and the durability and production rate of the backplane connector are increased.

3. The transversely formed partitions (14) function as crossbars to enhance the structurally strength of the housing (10).

4. The partitions (14) separate the terminal assemblies at intervals to facilitate the heat dissipation of the signal transmission terminals (40).

5. The longitudinally formed spine (17) also enhances the structural strength of the housing (10).

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A backplane connector comprising:

a housing having a top, a bottom and an expansion slot defined in the top of the housing; and multiple terminal assemblies mounted in the bottom of the housing and each terminal assembly having a first insulating base and a second insulating base connected to each other and mounted in the bottom of the housing; and two pairs of signal transmission terminals mounted respectively through the first insulating base and the second insulating base, the signal transmission terminals of each pair arranged symmetrically and each of the signal transmission terminals having a first mounting section mounted on one of the first insulating base or the second insulating base;

a first resilient arm formed on and protruding upward from the first mounting section;

a first contacting section formed on and protruding upward from the first resilient arm and having an inner side, wherein the inner sides of the first contacting sections of the signal transmission terminals of each pair are opposite and face each other;

a curved guiding element formed on the inner side; and an angled protruding element formed on the inner side and disposed under and adjacent to the curved guiding element;

a first soldering section formed on and protruding downward from first mounting section and extending out of the bottom of the housing, wherein the housing further has two pressing bars formed longitudinally in the expansion slot and are arranged symmetrically to each other;

the first contacting section of each signal transmission terminal further has a first abutting section formed on and protruding upward from the first contacting section and tightly abutting one of the pressing bars of the housing; and a second contacting section of a grounding terminal mounted through a mounting slot of the housing, further has a second abutting section formed on and protruding upward from the second contacting section and tightly abutting one of the pressing bars of the housing, wherein the first abutting section is L-shaped, and the second abutting section is L-shaped, wherein the curved guiding elements of the signal transmission terminals are convex and a curved guiding element of the grounding terminal is convex, and wherein the first soldering sections of the signal transmission terminals of each terminal assembly are arranged in a single transverse row relative to the housing.

2. The backplane connector as claimed in claim 1, wherein the housing further has multiple partitions formed transversely on the bottom of the housing and arranged longitudinally; and multiple assembling slots defined in the bottom of the housing and arranged alternately with the partitions so that each assembling slot is disposed between adjacent two of the partitions; and the terminal assemblies are mounted respectively through and correspond to the assembling slots of the housing and the connected first and second insulating bases of each terminal assembly are mounted in a corresponding assembling slot.

3. The backplane connector as claimed in claim 2, wherein the housing further has multiple mounting slots defined respectively in the partitions adjacent to the bottom of the housing and communicating with the expansion slot; and multiple grounding terminals are mounted respectively through the mounting slots of the housing.

4. The backplane connector as claimed in claim 3, wherein each grounding terminal has a second mounting section mounted in one of the mounting slots;

two second resilient arms formed on and protruding upward from the second mounting section and arranged symmetrically to each other;

two second contacting sections formed respectively on and protruding upward from the second resilient arm and each second contacting section having an inner side wherein the inner sides of the second contacting sections of the signal grounding terminals of each pair are opposite and face each other;

a curved guiding element formed on the inner side; and an angled protruding element formed on the inner side and disposed under and adjacent to the curved guiding element; and a second soldering section formed on and protruding downward from the second mounting section and extending out of the bottom of the housing.

5. The backplane connector as claimed in claim 4, wherein the housing further has a spine formed longitudinally on the housing between the expansion slot and the assembling slots.

* * * * *